United States Patent [19]

Kudo

[11] Patent Number: 4,700,757

[45] Date of Patent: Oct. 20, 1987

[54] SUPPORTING STRUCTURE FOR FUEL FEEDING GUN IN FUEL TANK

[75] Inventor: Takumi Kudo, Kariya, Japan

[73] Assignee: Kabushiki Kaisha Toyoda Jidoshokki Seisakusho, Kariya, Japan

[21] Appl. No.: 893,938

[22] Filed: Aug. 6, 1986

[30] Foreign Application Priority Data

Aug. 10, 1985 [JP] Japan ..... 60-123431[U]

[51] Int. Cl.[4] ..... B65B 3/24; B67C 3/34

[52] U.S. Cl. ..... 141/311 R; 141/392; 220/86 R

[58] Field of Search ..... 141/375, 392, 204, 390, 141/311 R; 220/86 R

[56] References Cited

U.S. PATENT DOCUMENTS 3,872,900 3/1975 Götz ..... 220/86 R

FOREIGN PATENT DOCUMENTS 56-18218 2/1981 Japan .

*Primary Examiner*—Houston S. Bell, Jr.

*Attorney, Agent, or Firm*—Brooks Haidt Haffner & Delahunty

[57] ABSTRACT

A supporting structure for a fuel feeding gun in a fuel tank is provided, comprising a cylindrical retainer provided in a portion of the fuel tank in which a barrel portion of the fuel feeding gun is inserted, and a support member provided correspondingly to a base end upper portion of the retainer which projects into the fuel tank in parallel with the axial line of the retainer and supports the barrel portion of the fuel feeding gun when the barrel portion is in the inserted state in the retainer.

4 Claims, 6 Drawing Figures

SUPPORTING STRUCTURE FOR FUEL FEEDING GUN IN FUEL TANK

FIELD OF THE INVENTION

This invention relates to industrial vehicles such as forklift trucks, and more particularly, to a supporting structure for a fuel feeding gun being inserted in a fuel inlet to pour fuel into a fuel tank.

DESCRIPTION OF THE RELATED ART

A common process of feeding fuel into a fuel tank in the field of industrial vehicles such as forklift trucks is to feed fuel by the use of a fuel feeding gun as is the case of a popular vehicle, that is, it generally comprises the steps of inserting a barrel portion of the fuel feeding gun in the fuel inlet of the fuel tank and spouting fuel out of the barrel portion into the fuel tank. According to this general process of performing fuel feeding by the use of the fuel feeding gun, however, under the condition that the barrel portion of the fuel feeding gun is inserted in the fuel inlet, an inconvenience tends to occur that the fuel feeding gun will revolve or come off the fuel inlet during the process of fuel feeding owing to an imbalance in weight between the gun body portion and the barrel portion. In view of such an inconvenience, in many cases, the fuel inlet 10 is opened so as to face vertically above as shown in FIG. 5, or to have a slight inclination from the vertical line as shown in FIG. 6.

However, if the fuel inlet is opened so as to face vertically above or to have a slight inclination from the vertical line, although this measure can prevent revolution and coming off of the fuel feeding gun during the process of fuel feeding, there arises another inconvenience that the work of fuel feeding is difficult to perform.

SUMMARY OF THE INVENTION

It is the object of the present invention to provide a supporting structure for a fuel feeding gun in a fuel tank which is capable of preventing revolution and coming off of the fuel feeding gun to permit a fuel inlet to be opened with a desired inclination (a comparatively gentle inclination) to thereby allow smooth performance of the work of fuel feeding by the use of the fuel feeding gun.

To achieve the foregoing object, the present invention provides a supporting structure for a fuel feeding gun in a fuel tank, comprising a cylindrical retainer provided in a portion of the fuel tank in which a barrel portion of the fuel feeding gun is inserted, and a support member provided correspondingly to a base end upper portion of the retainer which projects into the fuel tank in parallel with the axial line of the retainer and supports the barrel portion of the fuel feeding gun when the barrel portion is in the inserted state in the retainer.

Other objects of the present invention will become apparent upon understanding the embodiment hereinafter described and will be indicated clearly in the appended claims. Various advantages not referred to herein will occur to those skilled in the art upon practicing the present invention.

DESCRIPTION OF THE PREFERRED EMBODIMENT

Figure 1:
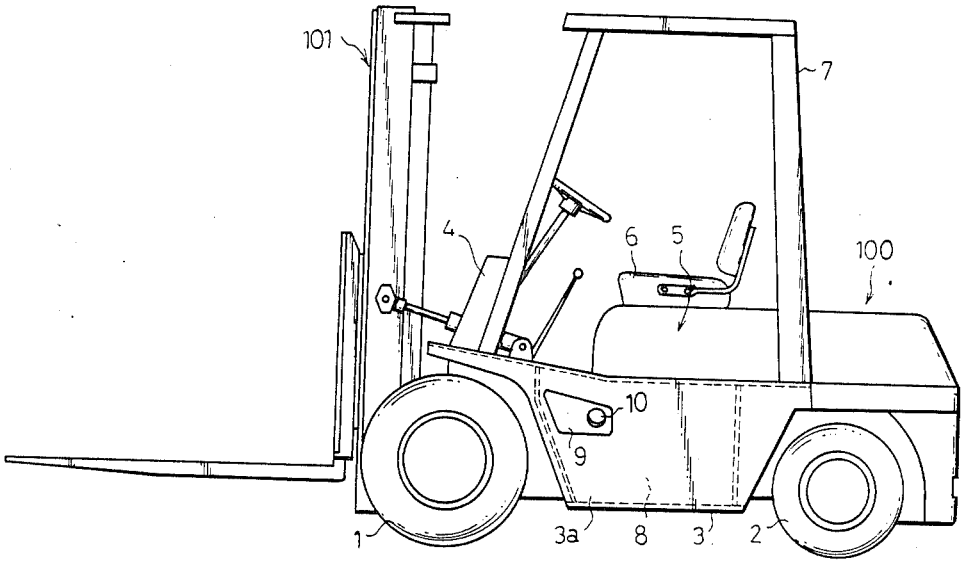
FIG. 1 is a side view of a forklift truck equipped with a supporting structure for a fuel feeding gun according to the present invention.
Figure 2:
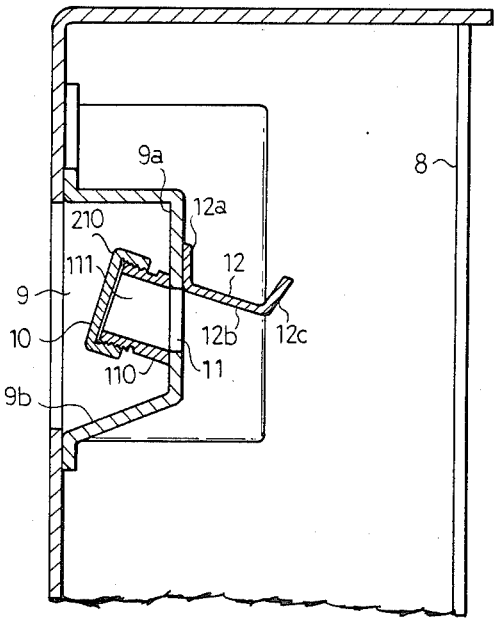
FIG. 2 is an enlarged sectional view of a fuel tank portion as viewed from one side.
Figure 3:
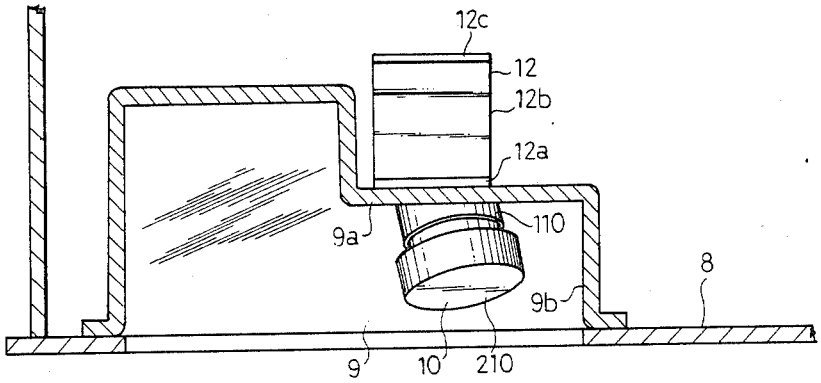
FIG. 3 is an enlarged sectional view of the fuel tank as viewed from the above.

A practical embodiment of the present invention will now be described with reference to the drawings.

In FIGS. 1 through 4, reference numeral 100 designates a truck body, and numeral 101 designates a lift mechanism mounted on the front portion of the truck body 100. In this truck body 100, numeral 1 designates a front wheel, numeral 2 designates a rear wheel, numeral 3 designates a chassis frame mounted on the front and rear wheels 1 and 2, numeral 4 designates a front protector, numeral 5 designates an engine hood, numeral 6 designates a driver's seat, and numeral 7 designates a head guard. On the chassis frame 3 and between side frames 3*a* and 3*a* there are mounted an engine, transmission case, clutch case and the like (not shown).

One side frame 3*a* has a fuel tank 8 attached on its inside and an indented section 9 formed on its outside at a position corresponding to the fuel tank 8 which serves also as a getting on/off step. The indented section 9 is formed by an erecting concave wall 9*a* and a peripheral wall 9*b* surrounding the concave wall 9*a* into a substantially rectangular shape, with the concave wall 9*a* having a fuel inlet 10 opened so as to communicate with the fuel tank 8. The fuel inlet 10 is made up of a cylindrical retainer 110 fixed on the outer surface of the concave wall 9*a* of the indented section 9 and a cap 210, with the retainer 110 erecting from the fuel tank 8 with an appropriate inclination, or a comparatively gentle inclination. A tip side opening portion 111 of the retainer 110 has a threaded portion and the cap 210 is detachably screwed on this threaded portion. The concave wall 9*a* has a support plate 12 for supporting a fuel feeding gun 13, which is attached to the inside surface (on the side of the fuel tank 8) so as to correspond to the opening portion (hereinafter referred to as a base side opening portion 11), on the side of the fuel tank 8, of the retainer 110. The support plate 12 consists of an attaching segment 12*a* to be fixed to the upper margin of the base side opening portion 11, an abutting segment 12*b* formed by bending the lower margin of the attaching segment 12*a* so as to extend toward the inside of the fuel tank 8, and a rising segment 12*c* formed by bending upward the tip margin of the abutting segment 12*b*, and is made into the form of a substantial "U". Further, the abutting segment 12*b* has the same inclination as that of the retainer 110. That is, this segment projects obliquely downward into the fuel tank 8 in parallel with the axial line of the retainer 110.

The action of the foregoing configuration will now be described.

Figure 4:
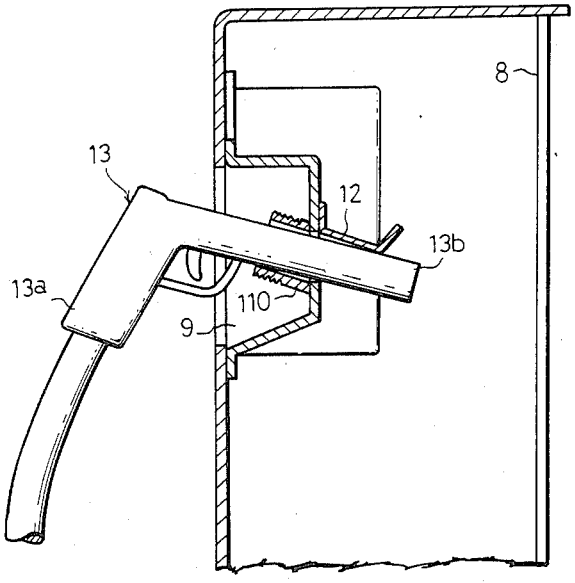
FIG. 4 is a sectional view of the fuel tank portion under service.
Figure 5:
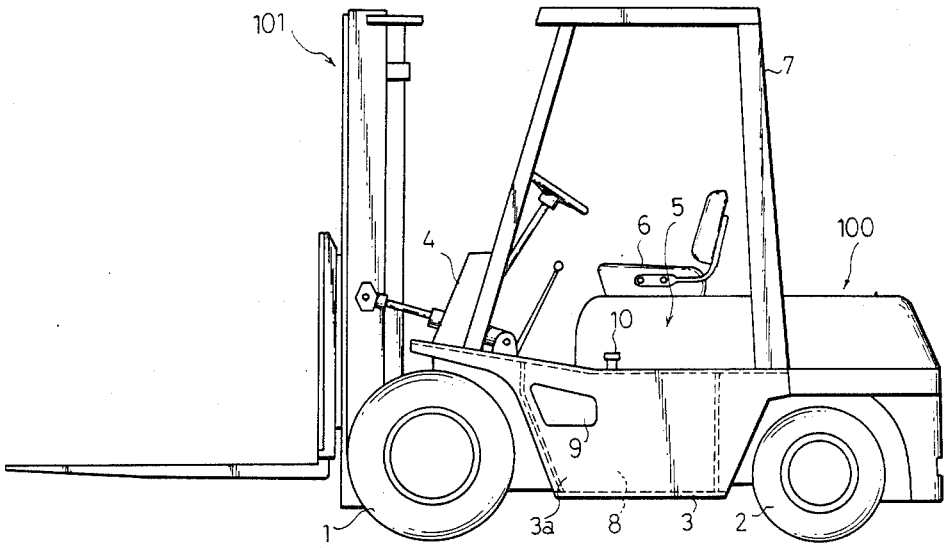
FIG. 5 (PRIOR ART)
FIGS. 5 and 6 are side views of forklift trucks provided with individual fuel inlets according to the related art.
Figure 6:
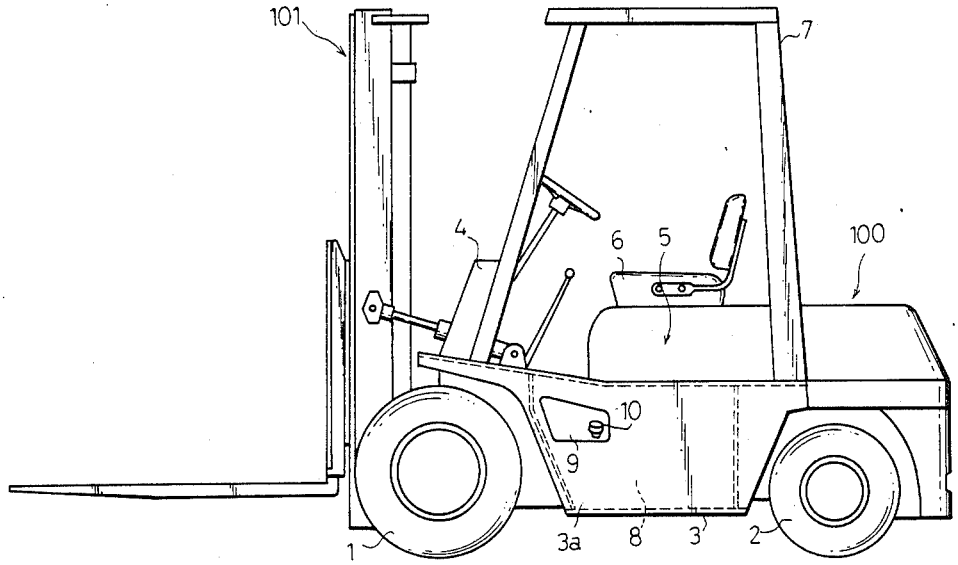
FIG. 6 (PRIOR ART)

In connection with the fuel inlet 10 provided projectingly in the indented section 9, remove the cap 210 from the retainer 110 and insert a barrel portion 13*b* of the fuel feeding gun 13 into the retainer 110 while supporting its body portion 13*a*. Further, pull a trigger while keeping the barrel portion 13*b* in the inserted state in the retainer 110, whereby fuel is spouted out from a nozzle portion formed in the tip portion of the barrel portion 13*b*, that is, the action of fuel feeding into the fuel tank 8 takes place. Then, under the condition that this fuel feeding action is taking place, the body portion 13*a* having been supported up to now is set free from an operator's hand. As a result, due to the action of an imbalance in weight between the side of the body portion 13*a* and the side of the barrel portion 13*b*, the fuel feeding gun 13 turns about the tip side opening portion 111 of the retainer 110, so that the side of the barrel portion 13*b* looks upward and hence the barrel portion 13*b* thus turned upward comes into abutment on the abutting segment 12*b* of the support plate 12. FIG. 4 illustrates the state wherein the barrel portion 13*b* is in abutment on the abutting segment 12*b* of the support plate 12. In this way, as the barrel portion 13*b* abuts on the abutting segment 12*b*, the fuel feeding gun 13 is held in the position just attained when it was inserted in the retainer 110, that is, there is obtained the effect that revolution and coming off of the fuel feeding gun 13 are prevented. For reference, it is possible to shorten in dimension the retainer 110 in proportion to the length of the support plate 12.

As described hereinabove, according to the present invention of the foregoing configuration, in connection with the fuel inlet 10 of the fuel tank 8, the retainer 110 projecting from the fuel tank 8 has the support plate 12 for the fuel feeding gun 13 attached to its base side opening portion 11 (on the side of the fuel tank), and by means of the action of an imbalance in weight arising between the body portion 13*a* and the barrel portion 13*b* of the fuel feeding gun 13, the barrel portion 13*b* of the fuel feeding gun 13 is caused to abut on the support plate 12, so that revolution and coming off of the fuel feeding gun 13 during the process of fuel feeding can effectively be prevented.

In addition, because revolution and coming off of the fuel feeding gun 13 are prevented as described above, the setting inclination of the retainer 110 can be made gently (or obtusely) as compared with the configuration of the related art, whereby it is possible to perform smoothly the work of fuel feeding.

Since it is apparent that many other modifications may be made without departing from the spirit and scope of the present invention, it is not intended to have the present invention limited to the specific embodiment thereof, except as defined in the appended claims.

What is claimed is:

1. A vehicle fuel tank having at least one wall formed by a substantially vertical exterior frame member of the vehicle, said vehicle frame member having an exterior surface, an interior surface, and means defining a laterally facing fuel-receiving aperture therethrough, and a fuel-feeding gun barrel supporting structure on said frame member adjacent to said fuel-receiving aperture, said supporting structure comprising a short-length cylindrical barrel retainer having an outer end and a base end attached to said frame member exterior surface in surrounding relation with said fuel-receiving aperture, said retainer projecting laterally in the exterior direction whereby its said cylindrical shape defines an upper portion and a lower portion thereof; and a short-length support member attached to said frame member interior surface adjacent to said fuel-receiving aperture in substantial alignment with said upper portion of said retainer and projecting inwardly of said tank to define an inner end of said support member whereby, when an elongated fuel-feeding gun barrel is inserted into said tank through said fuel-receiving aperture, said barrel is supported and retained by and between said support member inner end and said retainer outer end adjacent to said retainer lower portion.

2. A vehicle fuel tank according to claim 1, wherein said substantially vertical exterior frame member has an indented portion providing a substantially vertical inner wall which is disposed an indented distance from said frame member exterior surface in direction inwardly of said tank, said fuel-receiving aperture being in said indented inner wall, and said short-length retainer having length which is less than said distance of indentation of said indented inner wall.

3. A vehicle fuel tank according to claim 2, wherein said support member is a support plate which consists of an attaching segment attached to said interior surface of said substantially vertical inner wall, an abutting segment formed by bending said attaching segment to project inwardly of the fuel tank and abutable on the fuel-feeding gun barrel, and a rising segment formed by bending a tip portion of said abutting segment.

4. A vehicle fuel tank according to claim 3, wherein said retainer and said support plate have a gentle inclination with respect to said frame member inner wall, lowering progressively in direction towards the interior of the fuel tank.

* * * * *